United States Patent [19]

Donelan

[11] Patent Number: 4,887,195

[45] Date of Patent: Dec. 12, 1989

[54] ILLUMINATED HOUSE NUMBER ENCLOSURE

[76] Inventor: John M. Donelan, 12 Cambridge Rd., Norwood, Mass. 02062

[21] Appl. No.: 226,453

[22] Filed: Aug. 1, 1988

[51] Int. Cl.[4] ..... F21S 1/02

[52] U.S. Cl. ..... 362/147; 362/374; 362/433; 52/211; 40/574

[58] Field of Search ..... 362/145, 147, 151, 152, 362/311, 457, 433, 455, 812, 375, 374, 368, 370, 458; 40/564, 574, 578; 52/28, 211; 248/300, 265.1

[56] References Cited

U.S. PATENT DOCUMENTS

| | | | |
|---|---|---|---|
| 1,775,768 | 9/1930 | Kenerson | 362/147 |
| 2,188,404 | 1/1940 | Hengel | 40/564 |
| 2,734,123 | 2/1956 | Gerber | 363/145 |
| 2,910,184 | 1/1960 | Kessler | 262/152 |
| 3,500,600 | 3/1970 | Bagley, Sr. | 52/211 |
| 4,156,272 | 5/1979 | Wandler | 362/147 |
| 4,272,901 | 6/1981 | Matthews | 40/57 X |
| 4,373,284 | 2/1983 | Crane | 40/578 |
| 4,726,152 | 2/1988 | Vagedes et al. | 362/147 |

FOREIGN PATENT DOCUMENTS

| | | | |
|---|---|---|---|
| 3014303 | 10/1981 | Fed. Rep. of Germany | 362/37 X |
| 3016938 | 11/1981 | Fed. Rep. of Germany | 362/147 |
| 651575 | 2/1929 | France | 362/147 |

*Primary Examiner*—Ira S. Lazarus
*Assistant Examiner*—D. M. Cox

[57] ABSTRACT

This illuminated house number enclosure is designed to fit over an existing outside light fixture of a house, for easy identification of the house number at night and in bad weather. Primarily, it consists of a pair of mounting bases secured to shingle portions of a house, and a transparent main body is received on the mounting bases and includes numbers on its face for house identification.

1 Claim, 1 Drawing Sheet

ILLUMINATED HOUSE NUMBER ENCLOSURE

BACKGROUND OF THE INVENTION

1. Field of the Invention

This invention relates to illuminated displays, and more particularly, to an illuminated house number enclosure.

2. Description of Prior Art

References found are the U.S. Pat. Nos. of Arnold 3,680,238, Clark 1,651,084, and Passmore 1,600,243. While these inventions may be suitable for the articular purpose to which they address, they will not be as suitable for the purpose of the present invention, as hereinafter will be described.

The principal object of this invention is to provide an illuminated house number enclosure that will be of such design, as to not require additional cost in electricity to operate, and it will be quickly and easily installed on the existing outside lighting fixture of a house.

A further object of this invention is to provide an illuminated house number enclosure that will also be controlled by the existing inside electrical switch of the outside fixture.

SUMMARY OF THE INVENTION

An illuminated house number enclosure comprises a pair of bases mounted to the outside of a house, and a transparent main body is provided with a house number thereon and is removably received on the bases by suitable fasteners. The existing light fixture switch on the interior of the house is all that is required to illuminate the house number on the main body, as the fixture in the enclosure provides the light therefor.

DETAILED DESCRIPTION

Figure 1:
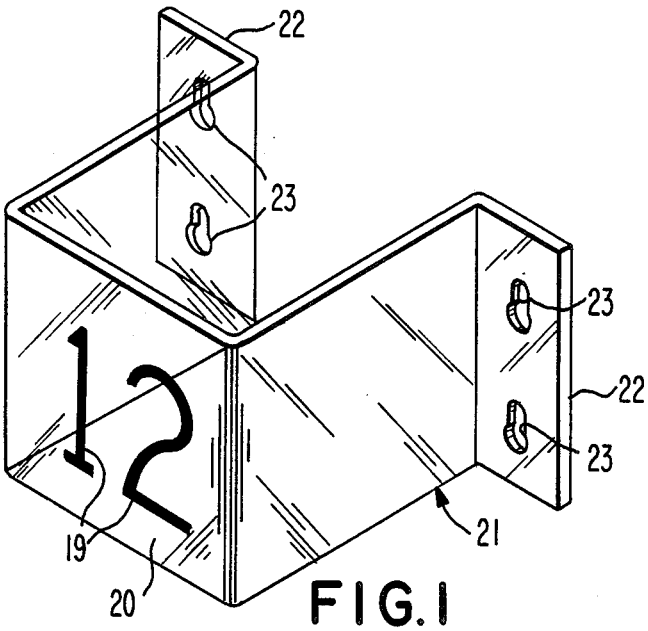
FIG. 1 is a fragmentary perspective view of the instant invention.
Figure 2:
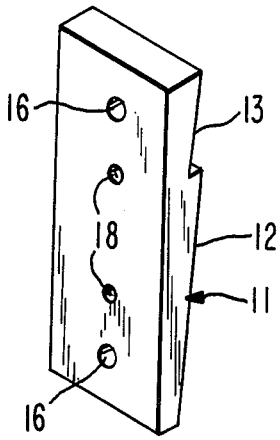
FIG. 2 is a perspective view of a mounting base thereof.
Figure 3:
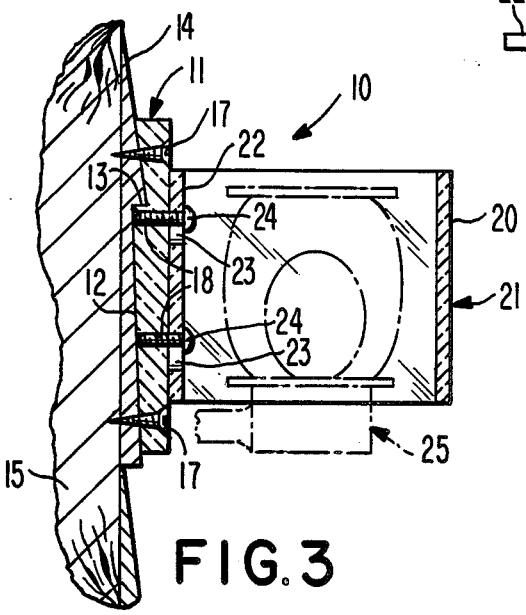
FIG. 3 is a side cross-sectional view of the enclosure assembly shown attached to a house, and the light fixture of the house is illustrated in phantom.
Figure 4:
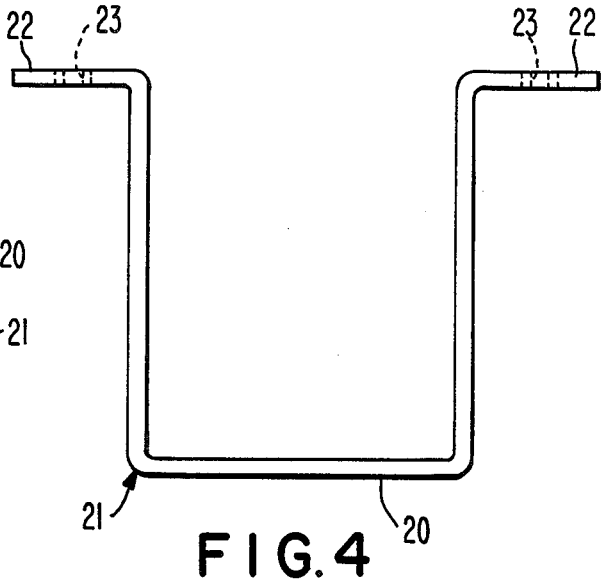
FIG. 4 is a top plan view of the main body shown removed therefrom.

Accordingly, an enclosure 10 is shown to include one base 11 of a pair (not shown), the rear surface 12 thereof, being provided with an agular cut-out opening 13 for engagement with the existing shingles 14 of a typical house 15. A pair of spaced outer openings 16 are provided through bases 11 and receive screw fasteners 17 that mount bases 11 to shingles 14.

A pair of spaced inner openings 18 are also provided through base 11, for a purpose which hereinafter will be described.

Numerical characters 19 are provided in front face 20 of a clear plastic main body 21, for being illuminated, and a pair of upwardly extending wings 22 are integrally attached to the open end of main body 21, and key-hole openings 23 are provided therethrough, for removably receiving a pair of screw fasteners 24 that are threaded into openings 18 that are also threaded. The assembly of enclosure 10 is designed for placement over the house 15 existing light fixture 25 for illumination of the numerical characters 19.

In use, the bases 11 are first mounted against the shingles 14 with the cut-out openings 13 in engagement with shingles 14. The fasteners 17 are provide for the mounting after openings are drilled through shingle 14. The fasteners 24 are then received in the threaded openings 18 leaving the heads extending therefrom, so as to accommodate the openings 23 and the wall thickness of the wings 22.

When it is desired to clean enclosure 10, the main body 21 is lifted upward and away from the bases 11, the reverse procedure being employed for the return of the main body 21, and when the house switch to the fixture 25 within the confines of main body 21 is turned on, the light therefrom illuminates the letter characters 19.

Figure 5:
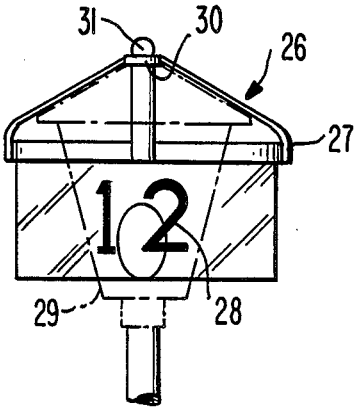
FIG. 5 is a fragmentary front elevational view of a modified form of the invention.
Figure 6:
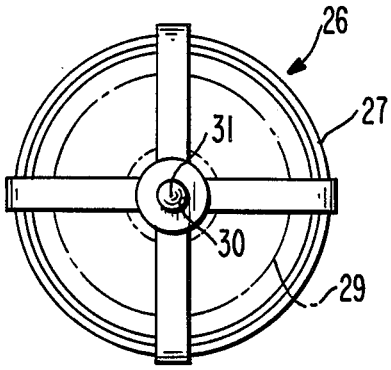
FIG. 6 is a top plan view of FIG. 5.

Looking now at FIGS. 5 and 6, a modified enclosure 26 is shown to include a transparent shade 27 having letter characters 28 provided thereon to be illuminated by post mounted electric or gas lamps 29.

An opening 30 is provided in the top of shade 27 for the extending knob 31 of the lamp 29 that is received on the interior of the shade 27.

In use, modified enclosure 26 functions for illumination of letter characters 28, in the same manner heretofore described of the enclosure 10.

While various changes may be made in the detailed description, such changes will be within the spirit and scope of the present invention, as defined by the appended claims.

What is claimed is:

1. An illuminated house number enclosure, for a house number located on a front wall of said enclosure, comprising, in combination, a transparent main body and a pair of bases for mounting said main body to a shingled siding of a house; said main body being vertically channel-shaped by comprising said front wall and a pair of opposite side walls integral therewith around a central space for receiving a lamp therein, and a sidewardly outward wing formed along a rear edge of each said side wall; each said base including a rear side having an angularly inclined, upper and lower face which are paralled to each other, said faces being stepped relative to each other so to form a single, horizontal step riser therebetween for abutment against an under side edge of a plank of said house shingled siding; a pair of keyhole-shaped openings in each said wing receiving headed screws therethrough for selectively dismounting said main body from said bases; and a pair of threaded openings in each said base receiving said headed screws, and a countersunk pair of openings in each said base receiving flat headed screws for fixedly mounting said bases to said house siding.

* * * * *